US008421835B2

(12) United States Patent
Furuta

(10) Patent No.: US 8,421,835 B2
(45) Date of Patent: Apr. 16, 2013

(54) EXPOSURE DEVICE CAPABLE OF STABILIZING DENSITY OF IMAGE FORMED BY MULTIPLE EXPOSURE AND IMAGE FORMING APPARATUS EQUIPPED WITH THE EXPOSURE DEVICE

(75) Inventor: Yasutomo Furuta, Abiko (JP)

(73) Assignee: Canon Kabushiki Kaisha (JP)

( * ) Notice: Subject to any disclaimer, the term of this patent is extended or adjusted under 35 U.S.C. 154(b) by 86 days.

(21) Appl. No.: 13/174,845

(22) Filed: Jul. 1, 2011

(65) Prior Publication Data

US 2012/0001995 A1 Jan. 5, 2012

(30) Foreign Application Priority Data

Jul. 2, 2010 (JP) ..... 2010-151988

(51) Int. Cl.
*B41J 2/435* (2006.01)

(52) U.S. Cl.
USPC ..... 347/236; 347/246; 347/237; 347/247

(58) Field of Classification Search ..... 347/236, 347/246, 237, 247
See application file for complete search history.

(56) References Cited

U.S. PATENT DOCUMENTS 5,726,437 A * 3/1998 Ashikaga et al. ..... 250/205
6,414,778 B1 * 7/2002 Hori ..... 359/204.1
2004/0056945 A1 * 3/2004 Takamatsu et al. ..... 347/237

FOREIGN PATENT DOCUMENTS

JP 2004-109680 A 4/2004

* cited by examiner

*Primary Examiner* — Stephen Meier
*Assistant Examiner* — Sarah Al Hashimi
(74) *Attorney, Agent, or Firm* — Rossi, Kimms & McDowell LLP

(57) ABSTRACT

An exposure device configured to perform exposure using a plurality of light beams and capable of stabilizing image density without increasing circuit size. The exposure device has a first light source for emitting a first light beam and a second light source for emitting a second light beam. The exposure device exposes a photosensitive drum such that areas exposed to the respective first and second light beams at least partially overlap each other. A first drive current having a predetermined value and a second drive current are supplied to the respective first and second light sources. A photodiode detects the intensities of the respective first and second light beams or the sum of the intensities. The second drive current is controlled based on a detection result from the photodiode such that the sum of the intensities becomes equal to a target intensity.

7 Claims, 15 Drawing Sheets

SCANNING POSITIONS ON PHOTOSENSITIVE DRUM

LASER SCANNING POSITIONS ON PD

EXPOSURE DEVICE CAPABLE OF STABILIZING DENSITY OF IMAGE FORMED BY MULTIPLE EXPOSURE AND IMAGE FORMING APPARATUS EQUIPPED WITH THE EXPOSURE DEVICE

BACKGROUND OF THE INVENTION

1. Field of the Invention

The present invention relates to an exposure device for irradiating a surface to be scanned with a plurality of light beams, and an image forming apparatus, and more particularly to an exposure device that performs light amount control on a plurality of light beams before scanning an image bearing member, such as a photosensitive member, as a surface to be scanned, and performs multiple exposure on the image bearing member with the light beams subjected to the light amount control to thereby form pixels, and an image forming apparatus equipped with the exposure device.

2. Description of the Related Art

There has generally been known an image forming apparatus, such as a copying machine or a printer, which performs image formation using so-called electrophotographic process. In recent years, it has been demanded that an image forming apparatus of this type forms high-quality images on a plurality of types of recording sheets (transfer sheets) at a high speed and with high accuracy.

An image forming apparatus using the electrophotographic process is provided with an optical scanning device (also referred to as "the exposure device"), and exposes a photosensitive member to a light beam emitted from the optical scanning device to thereby form an electrostatic latent image on the photosensitive member. In performing exposure of the photosensitive member, a light beam (also referred to as "a laser beam" or "laser light") is generated by a beam generator, such as a semiconductor laser, provided in the optical scanning device. The laser beam is deflected by a rotary polygon mirror (hereinafter simply referred to as "the polygon mirror") driven by a drive motor (hereinafter referred to as "the scanner motor") for rotation. The deflected laser beam is guided onto the photosensitive member, and the photosensitive member is exposed to the light beam, whereby an electrostatic latent image is formed on the photosensitive member.

In some image forming apparatuses of this type, in order to cope with an increase in printing speed and an increase in resolution, an increased number of beam generators are provided, thereby causing a photosensitive member to be simultaneously exposed to a plurality of light beams. In the case of exposure of a photosensitive member performed by an image forming apparatus using a plurality of light beams, an area exposed by a single exposure operation is larger than in the case of exposure of the same performed by an image forming apparatus using a single light beam. Therefore, the image forming apparatus which exposes the photosensitive member using a plurality of light beams can achieve a faster image forming speed than the mage forming apparatus which exposes the photosensitive member using a single light beam. However, when surface tilt of a polygon mirror occurs, a space interval (pitch) between adjacent line images (scanning lines) each formed using a plurality of light beams during a single scanning operation associated with one face of the polygon mirror differs from a space interval (pitch) between adjacent line images (scanning lines) each formed using the plurality of light beams during a single scanning operation associated with another face of the polygon mirror. Further, non-uniformity of space intervals between the beam generators causes non-uniformity of the space intervals between the line images on the photosensitive member. The non-uniformity of the space intervals becomes visually conspicuous depending on the number of light beams and the resolution of an image forming apparatus, which causes degradation of image quality.

For example, as a method of reducing the above-mentioned non-uniform density, there has been known a method in which an identical spot on a photosensitive member is exposed to a plurality of light beams deflected by respective different reflective surfaces of a polygon mirror (see Japanese Patent Laid-Open Publication No. 2004-109680). The method in which an electrostatic latent image is formed by exposing a once-exposed spot again is called "multiple exposure". By forming an image by the multiple exposure, a periodic positional displacement caused by a surface tilt of the polygon mirror, different light beam pitches or the like can be made inconspicuous.

However, the apparatus disclosed in Japanese Patent Laid-Open Publication No. 2004-109680 suffers from the following problems: Light amount control is performed so as to hold the light amount of a light beam at a predetermined light amount. The light amount control is performed as follows: First, a light beam emitted from each beam generator is detected by a photodiode (PD), and the light amount of the light beam is detected from a result of the detection. Then, a comparison is performed between the detected light amount and a target light amount, and the value of a drive current to be supplied to the beam generator is controlled such that the light amount of the light beam becomes equal to the target light amount. This method is generally referred to as "APC (automatic power control". Note that APC is performed by detecting light beams from the respective beam generators using the photodiode in a non-image area during image formation. In an image area immediately after a non-image area within one scanning cycle, a drive current controlled based on a detection result from the photodiode is supplied to each beam generator, whereby a controlled light beam is emitted from the beam generator. Further, for light beams to be emitted from the respective beam generators, APC is performed using the photodiode common to the beam generators, and hence the beam generators emit the respective light beams in timings different from each other during APC in the non-image area.

The image forming apparatus disclosed in Japanese Patent Laid-Open Publication No. 2004-109680 is configured to form each dot by a plurality of exposure operations, and hence it is required to increase the number of light beams in comparison with a case where each dot is formed by a single exposure operation. When it is required to perform APC in each scanning cycle for each of the light beams emitted from the respective beam generators, time required for execution of APC increases, making it difficult to perform APC for all the light beams in a non-image area between scanning lines. If APC is not performed for some beam generators, variation in light amount is liable to occur between the scanning lines, causing non-uniform density. Further, it is required to provide each of the beam generators with a control circuit for performing APC, which causes an increase in circuit size.

SUMMARY OF THE INVENTION

The present invention provides an exposure device configured to perform exposure using a plurality of light beams and capable of stabilizing image density without increasing circuit size, and an image forming apparatus equipped including the exposure device.

In a first aspect of the present invention, there is provided an exposure device including a first light source for emitting a first light beam for exposing a photosensitive member and a second light source for emitting a second light beam for exposing the photosensitive member, and configured to irradiate the photosensitive member such that an area exposed to the first light beam and an area exposed to the second light beam are at least partially overlap each other, comprising a current supply unit configured to supply the first light source with a first drive current having a predetermined value for causing the first light source to emit the first light beam, and supply the second light source with a second drive current for causing the second light source to emit the second light beam, a detection unit configured to detect an intensity of the first light beam and an intensity of the second light beam, or a sum of the intensity of the first light beam and the intensity of the second light beam, and a control unit configured to control a value of the second drive current, based on a detection result from the detection unit, such that the sum of the intensity of the first light beam and the intensity of the second light beam becomes equal to a target intensity.

In a second aspect of the present invention, there is provided an image forming apparatus including an exposure device and configured to perform image formation by causing the exposure device to scan and exposure a photosensitive member according to image data, to thereby form an electrostatic latent image corresponding to the image data on the photosensitive member, and then developing the electrostatic latent image, wherein the exposure device includes a first light source for emitting a first light beam for exposing a photosensitive member and a second light source for emitting a second light beam for exposing the photosensitive member, and configured to irradiate the photosensitive member such that an area exposed to the first light beam and an area exposed to the second light beam are at least partially overlap each other, and comprises a current supply unit configured to supply the first light source with a first drive current having a predetermined value for causing the first light source to emit the first light beam, and supply the second light source with a second drive current for causing the second light source to emit the second light beam, a detection unit configured to detect an intensity of the first light beam and an intensity of the second light beam, or a sum of the intensity of the first light beam and the intensity of the second light beam, and a control unit configured to control a value of the second drive current, based on a detection result from the detection unit, such that the sum of the intensity of the first light beam and the intensity of the second light beam becomes equal to a target intensity.

According to the present invention, since the second drive current to be supplied to the second light source is controlled to thereby control the sum of the intensity of the first light beam and that of the second light beam to the target intensity, it is possible to simplify the circuit configuration of the exposure device.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiments thereof. First, a description will be given of an image forming apparatus including an exposure device of a first embodiment of the present invention.

In the first embodiment, the exposure device has a light source for irradiating a photosensitive drum as a photosensitive member with a plurality of light beams (laser beams) and performs multiple exposure for scanning or exposing identical spots on the photosensitive drum using the light beams. More specifically, a plurality of laser beams emitted from respective different light emitters are scanned on the photosensitive drum such that laser beam spots (exposed areas) totally or at least partially overlap each other. For example, the exposure device causes a group of laser elements to simultaneously illuminate for scanning and exposing identical spots on the photosensitive drum. Then, the exposure device controls the amount of light emitted from one laser element of the laser element group such that the total light amount of light emitted from the laser element group becomes equal to a predetermined light amount (hereinafter referred to as "the target multi-exposed-spot light amount) (this control is performed e.g. according to APC (automatic power control)). In the present embodiment, the image forming apparatus performs multiple exposure using eight laser beams for image forming operation, by way of example.

Figure 1:
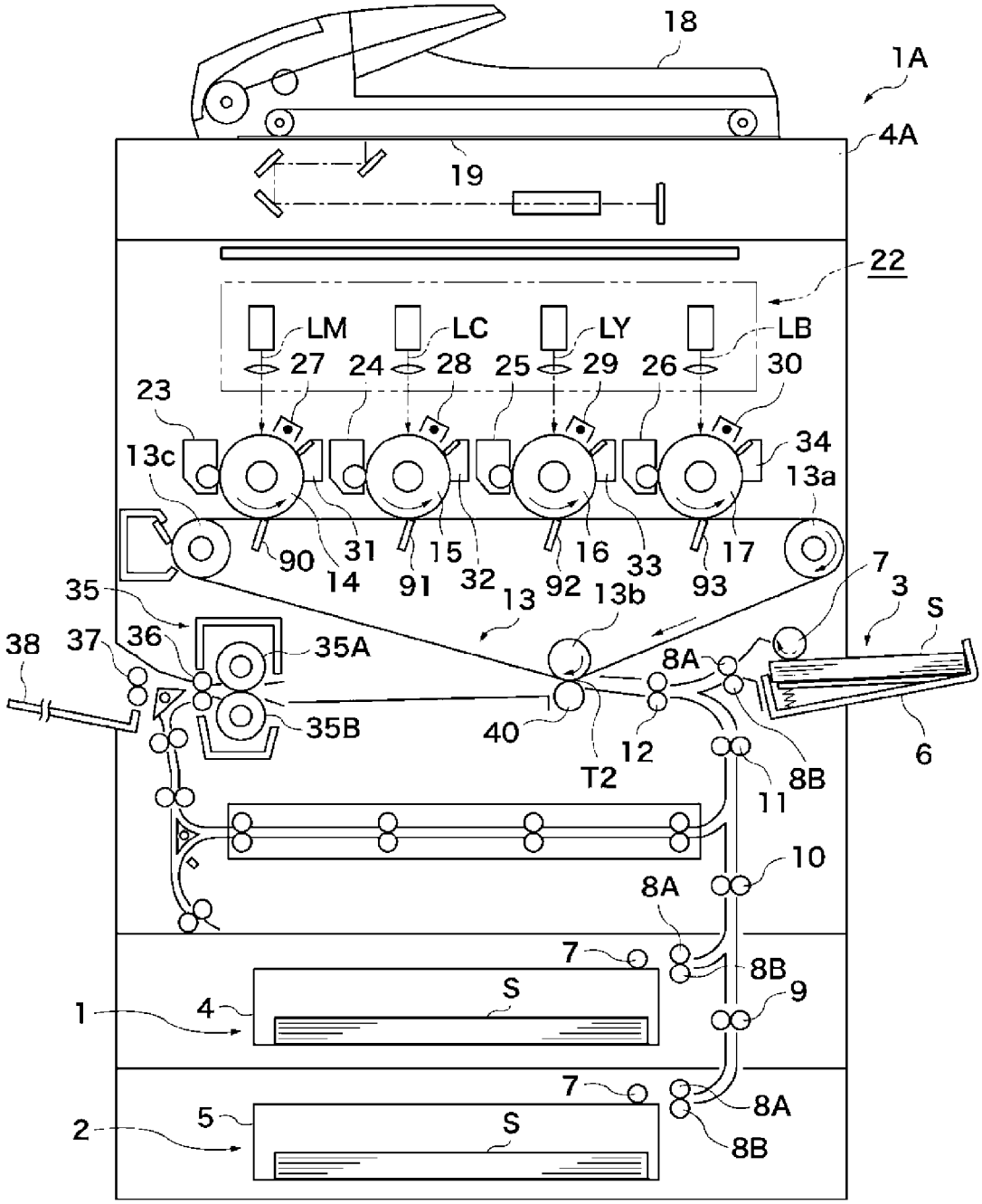
FIG. 1 is a cross-sectional view of an image forming apparatus including an exposure device according to a first embodiment of the present invention.

FIG. 1 is a cross-sectional view of the image forming apparatus including the exposure device according to the first embodiment. Note that the image forming apparatus shown in FIG. 1 forms a color image by superimposing respective images of the colors of cyan (C), magenta (M), yellow (Y), and black (K) one upon another.

The image forming apparatus 1A shown in FIG. 1 has four photosensitive drums 14, 15, 16, and 17 as photosensitive members. An intermediate transfer belt (endless belt) 13 as an intermediate transfer member is disposed in facing relation to the photosensitive drums 14, 15, 16, and 17. The intermediate transfer belt 13 is stretched around a driving roller 13*a*, a secondary transfer opposed roller 13*b*, and a tension roller (driven roller) 13*c* such that the general shape of the intermediate transfer belt 13 in cross-sectional view is triangular. The intermediate transfer belt 13 rotates in a clockwise direction as viewed in FIG. 1 (i.e. in a direction indicated by a solid-line arrow in FIG. 1). The photosensitive drums 14, 15, 16, and 17 are arranged in the direction of rotation of the intermediate transfer belt 13.

Around the photosensitive drum 14, there are arranged an electrostatic charger 27, a developing device 23, and a cleaner 31. Similarly, arranged around each of the photosensitive drums 15, 16, and 17 are an associated one of electrostatic chargers 28, 29, and 30, an associated one of developing devices 24, 25, and 26, and an associated one of cleaners 32, 33, and 34.

The electrostatic chargers 27, 28, 29, and 30 uniformly charge the surfaces of the photosensitive drums 14, 15, 16, and 17, respectively. An exposure device 22 is disposed above the photosensitive drums 14, 15, 16, and 17 and scans the surfaces of the respective photosensitive drums 14, 15, 16, and 17 with laser beams (light beams), described hereinafter, according to image data. Note that in the example shown in FIG. 1, the photosensitive drums 14, 15, 16, and 17 correspond to magenta (M) toner, cyan (C) toner, yellow (Y) toner, and black (K) toner, respectively.

Now, a description will be given of an image forming (printing) operation performed by the image forming apparatus 1A shown in FIG. 1. The image forming apparatus 1A shown in FIG. 1 has two cassette sheet feeders 1 and 2 and a manual sheet feeder 3. Recording sheets (transfer sheets) S are selectively fed from the cassette sheet feeders 1 and 2 and the manual sheet feeder 3. The cassette sheet feeders 1 and 2 have respective cassettes 4 and 5, and the manual sheet feeder 3 has a tray 6. Transfer sheets S are stacked on each of the cassettes 4 and 5 or the tray 6, and are picked up sequentially from an uppermost one by an associated pickup roller 7. Then, only the uppermost transfer sheet S is separated from the other picked-up sheets S by a separation roller pair 8 formed by a feed roller 8A and a retard roller 8B. A transfer sheet S fed from the cassette sheet feeder 1 or 2 is conveyed to a registration roller pair 12 via a conveying roller pair 9 and/or a conveying roller pair 10, and a conveying roller pair 11. On the other hand, a transfer sheet S fed from the manual sheet feeder 3 is immediately conveyed to the registration roller pair 12. Then, the conveyance of the transfer sheet S is temporarily stopped by the registration roller pair 12, and skew of the transfer sheet S is corrected.

The image forming apparatus 1A is provided with an original feeder 18, and the original feeder 18 sequentially feeds originals stacked thereon, one by one, onto an original platen glass 19. When an original is conveyed to a predetermined position on the original platen glass 19, a scanner unit 4A illuminates the surface of the original, and reflected light from the original is guided to a lens (not shown) via mirrors and so forth (not shown). Then, the reflected light forms an optical image on an image sensor unit (not shown). The image sensor unit photoelectrically converts the formed optical image to an electric signal. The electric signal is input to an image processor 107 (see FIG. 6). The image processor 107 converts the electric signal to a digital signal and then performs required image processing on the digital signal to thereby generate image data. The image data is input to the exposure device (hereinafter also referred to as "the exposure controller") 22 directly or after having been temporarily stored in an image memory (not shown). The exposure controller 22 drives semiconductor lasers, not shown, according to the image data. This causes laser beams (light beams) to be emitted from the semiconductor lasers.

Each of the laser beams is irradiated onto the surface of an associated one of the photosensitive drums 14, 15, 16, and 17 by the electrostatic charger 27, 28, 29, and 30 via a scanning system including a rotary polygon mirror (hereinafter simply referred to as "the polygon mirror"). The laser beam is deflected by the polygon mirror to scan the surface of the associated one of the photosensitive drums 14, 15, 16, and 17 in the main scanning direction (i.e. along the rotational axis of each of the photosensitive drums 14, 15, 16, and 17). Each of the photosensitive drums 14, 15, 16, and 17 rotates in a direction (sub scanning direction) indicated by a solid-line arrow in FIG. 1, so that the photosensitive drums 14, 15, 16, and 17 are each scanned in the sub scanning direction as well by the laser beams, and electrostatic latent images are formed on the respective photosensitive drums 14, 15, 16, and 17 according to the image data by the scanning of the laser beams. The electrostatic latent image formed on each of the photosensitive drums 14, 15, 16, and 17 is developed by toner held by an associated one of developing devices 23, 24, 25, and 26 disposed close to the respective photosensitive drums 14, 15, 16, and 17.

In the image forming apparatus of the present embodiment, the photosensitive drum 14 is exposed by a laser beam LM based on a magenta component of the image data. As a consequence, an electrostatic latent image is formed on the photosensitive drum 14. Then, the electrostatic latent image on the photosensitive drum 14 is developed by the developing device 23 into a magenta (M) toner image. Then, when a predetermined time period has elapsed after the start of the exposure of the photosensitive drum 14, the photosensitive drum 15 is exposed by a laser beam LC based on a cyan component of the image data. As a consequence, an electrostatic latent image is formed on the photosensitive drum 15. The electrostatic latent image on the photosensitive drum 15 is developed by the developing device 24 into a cyan (C) toner image.

Further, when the predetermined time period has elapsed after the start of the exposure of the photosensitive drum 15, the photosensitive drum 16 is exposed by a laser beam LY based on a yellow component of image data. As a consequence, an electrostatic latent image is formed on the photosensitive drum 16. The electrostatic latent image on the photosensitive drum 16 is developed by the developing device 25 into a yellow (Y) toner image. Then, when the predetermined time period has elapsed after the start of the exposure of the photosensitive drum 16, the photosensitive drum 17 is exposed by a laser beam LB based on a black component of image data. As a consequence, an electrostatic latent image is formed on the photosensitive drum 17. The electrostatic latent image on the photosensitive drum 17 is developed by the developing device 26 into a black (K) toner image.

The M toner image on the photosensitive drum 14 is transferred onto the intermediate transfer belt 13 by a transfer charger 90. Similarly, the C toner image, the Y toner image, and the K toner image are transferred from the photosensitive drums 15, 16, and 17 onto the intermediate transfer belt 13 by transfer chargers 91, 92, and 93, respectively. As a consequence, the M toner image, the C toner image, the Y toner image, and the K toner image are transferred onto the intermediate transfer belt 13 in superimposed relation, whereby a color toner image is formed as a primary transfer image on the intermediate transfer belt 13. Note that toners remaining on the respective photosensitive drums 14, 15, 16, and 17 after the transfer of the toner images are removed by the cleaners 31, 32, 33, and 34, respectively.

The transfer sheet S temporarily stopped at the registration roller pair 12 is conveyed to a secondary transfer position T2 by the registration roller pair 12 being driven. At this time, the registration roller pair 12 is driven for rotation in timing synchronous with alignment between the color toner image on the intermediate transfer belt 13 and the leading edge of the transfer sheet S, whereby the transfer sheet S is conveyed to the secondary transfer position T2. At the secondary transfer position T2, there are disposed a secondary transfer roller 40 and the secondary transfer opposed roller 13*b*, and the color toner image on the intermediate transfer belt 13 is transferred as a secondary transfer image onto the transfer sheet S at the secondary transfer position T2. The transfer sheet S having passed through the secondary transfer position T2 is conveyed to a fixing device 35. The fixing device 35 has a fixing roller 35A and a pressure roller 35B. The transfer sheet S is heated by the fixing roller 35A and pressed by the pressure roller 35B during passage through a nip formed by the fixing roller 35A and the pressure roller 35B. As a consequence, the secondary transfer image is fixed on the transfer sheet S. The transfer sheet S having undergone the fixing processing is conveyed to a discharge roller pair 37 by a conveying roller pair 36 and is discharged onto a discharge tray 38 by the discharge roller pair 37.

Figure 2:
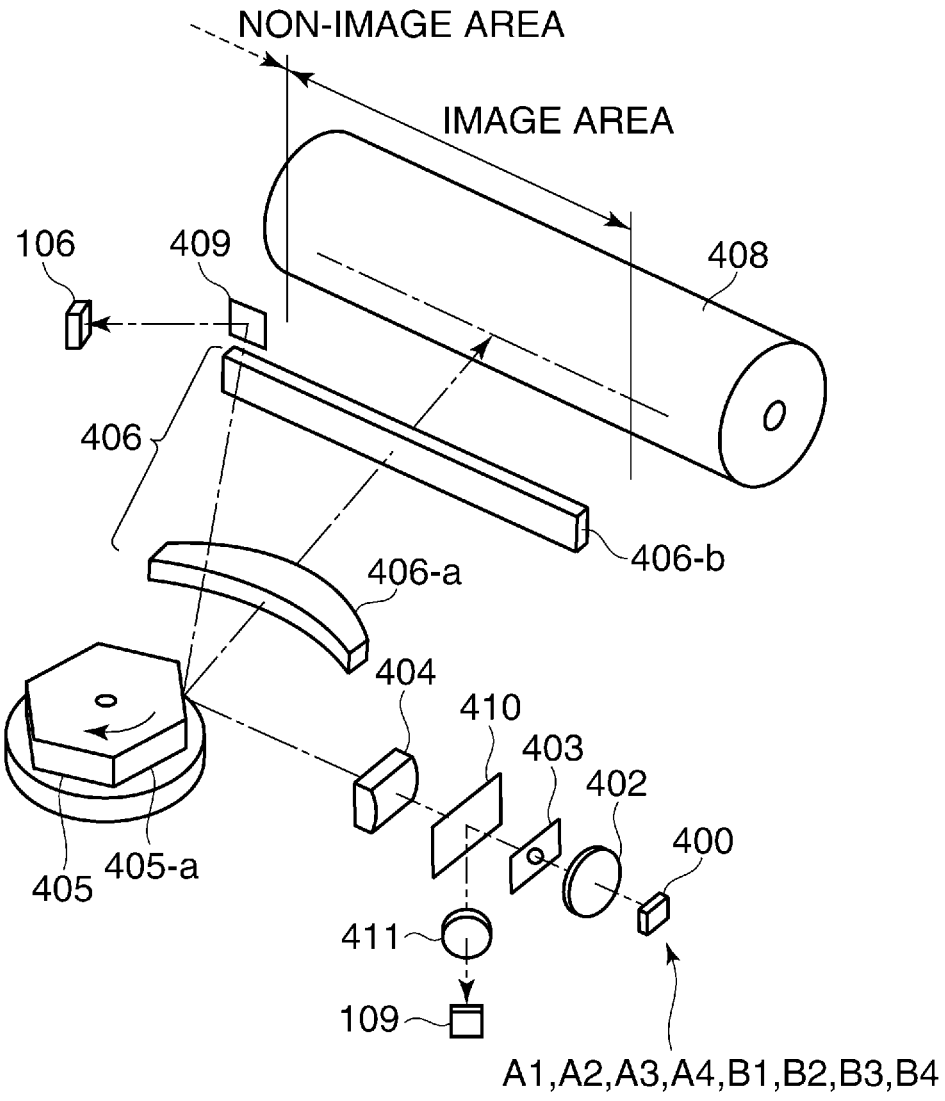
FIG. 2 is a perspective view useful in explaining an optical system of the exposure device appearing in FIG. 1.

FIG. 2 is a perspective view useful in explaining an optical system of the exposure device 22 appearing in FIG. 1. In FIG. 2, only an optical system associated with the photosensitive drum 14 is shown for convenience of description. An optical system associated with each of the other photosensitive drums 15, 16, and 17 is identical in construction to the optical system appearing in FIG. 2, and therefore description thereof is omitted.

The exposure device 22 has a semiconductor laser 400 which comprises a plurality of laser elements (light sources) A1, A2, A3, A4, B1, B2, B3, and B4. When supplied with a drive current, each of the laser elements A1 to A4 and B1 to B4 outputs a laser beam (light beam) having an intensity (light amount) corresponding to the value of the drive current.

Each of the laser beams enters a polygon mirror (deflection unit) 405 via a collimator lens 402, an aperture stop 403, a half mirror 410, and a cylindrical lens 404. Then, the laser beams are reflected on a reflective surface (polygon surface) 405-*a* of the polygon mirror 405 and pass through a toric lens 406-*a* and a diffractive optical element 406-*b*, to each form an image on a photosensitive drum 408.

The laser beams emitted from the laser elements A1 to A4 and B1 to B4 are divergent light, and therefore the collimator lens 402 converts the laser beams to a substantially parallel light flux. The aperture stop 403 restricts the light flux passing therethrough. The cylindrical lens 404 has a predetermined refractive power only in the sub scanning direction. The cylindrical lens 404 causes the laser beams having passed through the aperture stop 403 to form an image within a sub scanning cross section on the reflective surface 405-*a* of the polygon mirror 405. During the process, the polygon mirror 405 is being rotated at a fixed speed by a drive source (not shown) such as a motor. The polygon mirror 405 deflects and scans the laser beams having formed the image on its reflective surface 405-*a*.

The toric lens 406-*a* and the diffractive optical element 406-*b* constitute an optical element 406 having an f-θ characteristic. The optical element 406 comprises a refraction unit and a diffraction unit. The refraction unit is defined by the toric lens 406-*a*. The Toric Lens 406-*a* has different powers which act in the main scanning direction and in the sub scanning direction, respectively. The lens surface of the toric lens 406-*a* in the main scanning direction is formed to have a non-spherical shape. On the other hand, the diffraction unit is defined by the diffractive optical element 406-*b*. The diffractive optical element 406-*b* is elongated in shape, and has different powers which act in the main scanning direction and in the sub scanning direction, respectively.

A reflecting mirror 409 associated with a beam detecting sensor (hereinafter referred to as "the BD sensor") 106 is disposed in a beam scanning area outside an image area (hereinafter referred to as "the non-image area").

Each laser beam deflected and scanned by the polygon mirror 405 is reflected on the reflecting mirror 409 and is incident on the light receiving surface of the BD sensor 106. The BD sensor 106 detects the incident laser beam and outputs a BD detection signal. The timing of exposure of the photosensitive drum 408 is controlled according to beam detection timing in which the laser beam is detected, i.e. according to the BD detection signal. Further, in the present embodiment, part of a laser beam emitted from each of the laser elements A1 to A4 and B1 to B4 is reflected by the half mirror 410. The reflected beams enter a single photodiode (detection unit) 109 via a condensing lens 411 (which means that the photodiode 109 is disposed at a location where the reflected beams can be received). The photodiode 109 detects the light amount (i.e. intensity) of each of the reflected beams.

Figure 3:
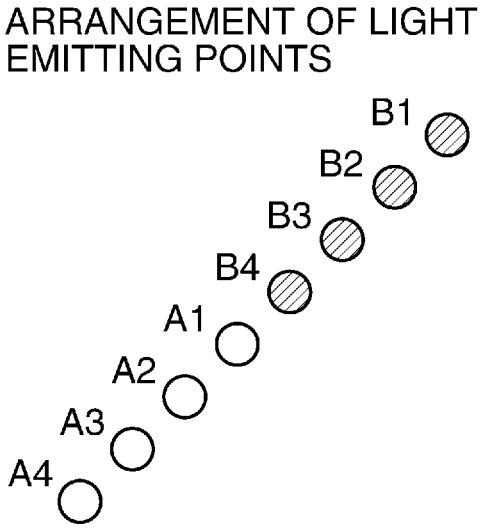
FIG. 3 is a view useful in explaining the arrangement of a semiconductor laser appearing in FIG. 2.

FIG. 3 is a view useful in explaining the arrangement of the semiconductor laser 400 appearing in FIG. 2. Referring to FIG. 3, the semiconductor laser 400 has eight laser elements (light sources) A1 to A4 and B1 to B4. The laser elements A1 to A4 and B1 to B4 are arranged on the same chip. FIG. 3 illustrates the positions of light emitting points of the respective laser elements A1 to A4 and B1 to B4 on the surface of the chip. The laser elements A1 to A4 and B1 to B4 are arranged in a line at equal space intervals. Note that in the figure, a vertical direction corresponds to the sub scanning direction, and a horizontal direction corresponds to the main scanning direction.

Figure 4:
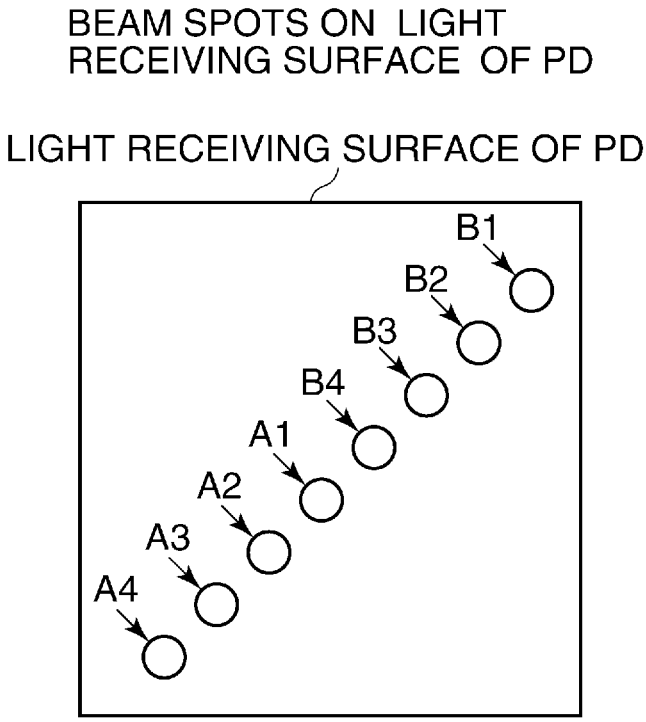
FIG. 4 is a view of irradiation spots of reflected light beams on a light receiving surface of a photodiode (PD) appearing in FIG. 2.

FIG. 4 is a view of irradiation spots, irradiated by reflected light beams, on a light receiving surface of the photodiode 109 appearing in FIG. 2. In FIG. 4, these irradiation spots are denoted by the same reference numerals as those of the laser elements A1 to A4 and B1 to B4 A1 to A4 and B1 to B4 associated therewith respectively, and in the figure, a vertical direction corresponds to the sub scanning direction, and a horizontal direction corresponds to the main scanning direction. Referring to FIG. 4, light beams from the laser elements A1 to A4 and B1 to B4 are condensed such that the irradiation spots are arranged within the light receiving surface of the photodiode 109. In the present example, part of each laser beam is reflected by the half mirror 410, and the reflected beam is detected by the single photodiode 109. In this case, the light amount ratio between the light amount of part of the laser beam that reaches the photosensitive drum 408 and that of part of the laser beam that reaches the photodiode 109 is constant irrespective of the laser elements A1 to A4 and B1 to B4. This makes it possible to control the light amount of a laser beam from each of the laser elements A1 to A4 and B1 to B4 based on the amount of light received by the photodiode 109 (received light intensity) to thereby control the light amount of each laser beam that reaches the photosensitive drum 408 to a constant level.

Note that the light amount ratio is determined by reflectance and transmittance of the optical components (e.g. mirrors and lenses). In light amount adjustment in a factory, the semiconductor laser 400 is illuminated, and an amount of light received by the photodiode 109 when the amount of light at a spot subjected to the multiple exposure (hereinafter referred to as a "multi-exposed-spot") on the photosensitive drum 408 reaches a predetermined amount is set as a target multi-exposed-spot light amount. In the case of image formation, the amount of light to be emitted from the semiconductor laser 400 is controlled such that the amount of light received by the photodiode 109 will become equal to the target multi-exposed-spot light amount.

Figure 5:
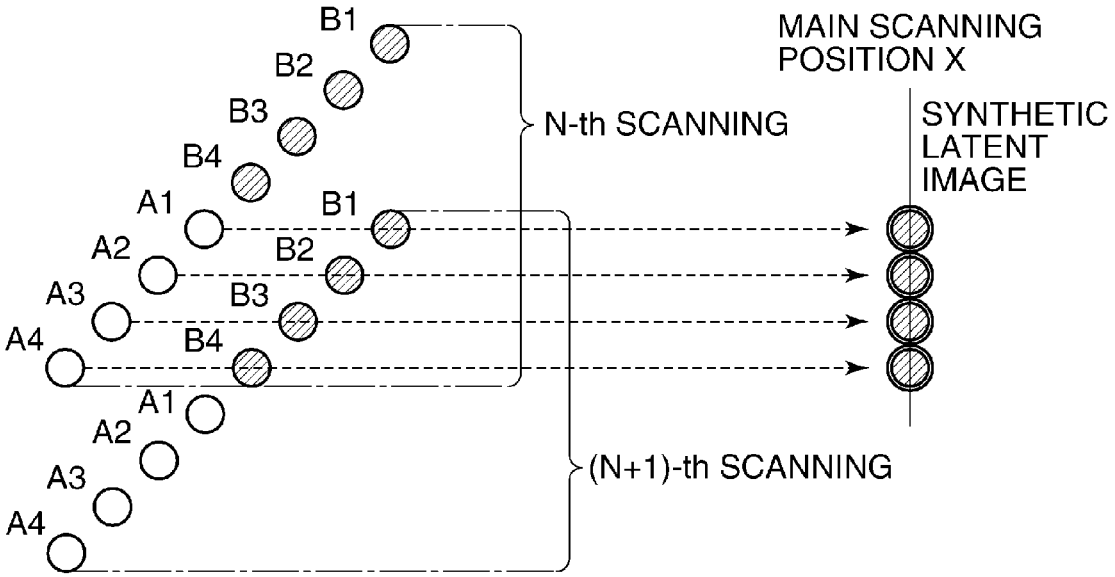
FIG. 5 is a view of an example of the arrangement of laser spots formed on a photosensitive drum appearing in FIG. 2.

FIG. 5 is a view of an example of the arrangement of laser spots formed on the photosensitive drum 408 appearing in FIG. 2. In FIG. 5, laser beams and laser spots corresponding to the respective laser elements A1 to A4 and B1 to B4 are denoted by the same reference numerals A1 to A4 and B1 to B4, respectively. In the example shown in FIG. 5, the photosensitive drum 408 is scanned and exposed using the eight laser beams A1 to A4 and B1 to B4 as described hereinbefore. In this case, identical spots for exposure on the photosensitive drum 408 are subjected to multiple exposure to laser beams reflected from adjacent reflective surfaces of the polygon mirror. As illustrated in FIG. 5, spots on the photosensitive drum 408 are subjected to multiple exposure to the laser beams A1 to A4 in an N-th (N is an integer $\geqq 1$) scanning and the laser beams B1 to B4 in an (N+1)-th scanning, respectively. For example, the laser spots A1 and B1 form a multi-exposed-spot (represented by a synthetic latent image in FIG. 5) in a main-scanning position X. Similarly, the laser spots A2 and B2, the laser spots A3 and B3, and the laser spots A4 and B4 form respective multi-exposed-spots (synthetic latent images) in the main-scanning position X.

When image writing in the sub scanning direction is started, laser beams are emitted from the respective laser elements A1 to A4 of all the laser elements A1 to A4 and B1 to B4, but the laser elements B1 to B4 are inhibited from emitting laser beams. Further, when image writing is performed for positions at an end in the sub scanning direction, laser beams are emitted from the respective laser elements B1 to B4 of all the laser elements A1 to A4 and B1 to B4, but the laser elements A1 to A4 are inhibited from emitting laser beams.

Figure 6:
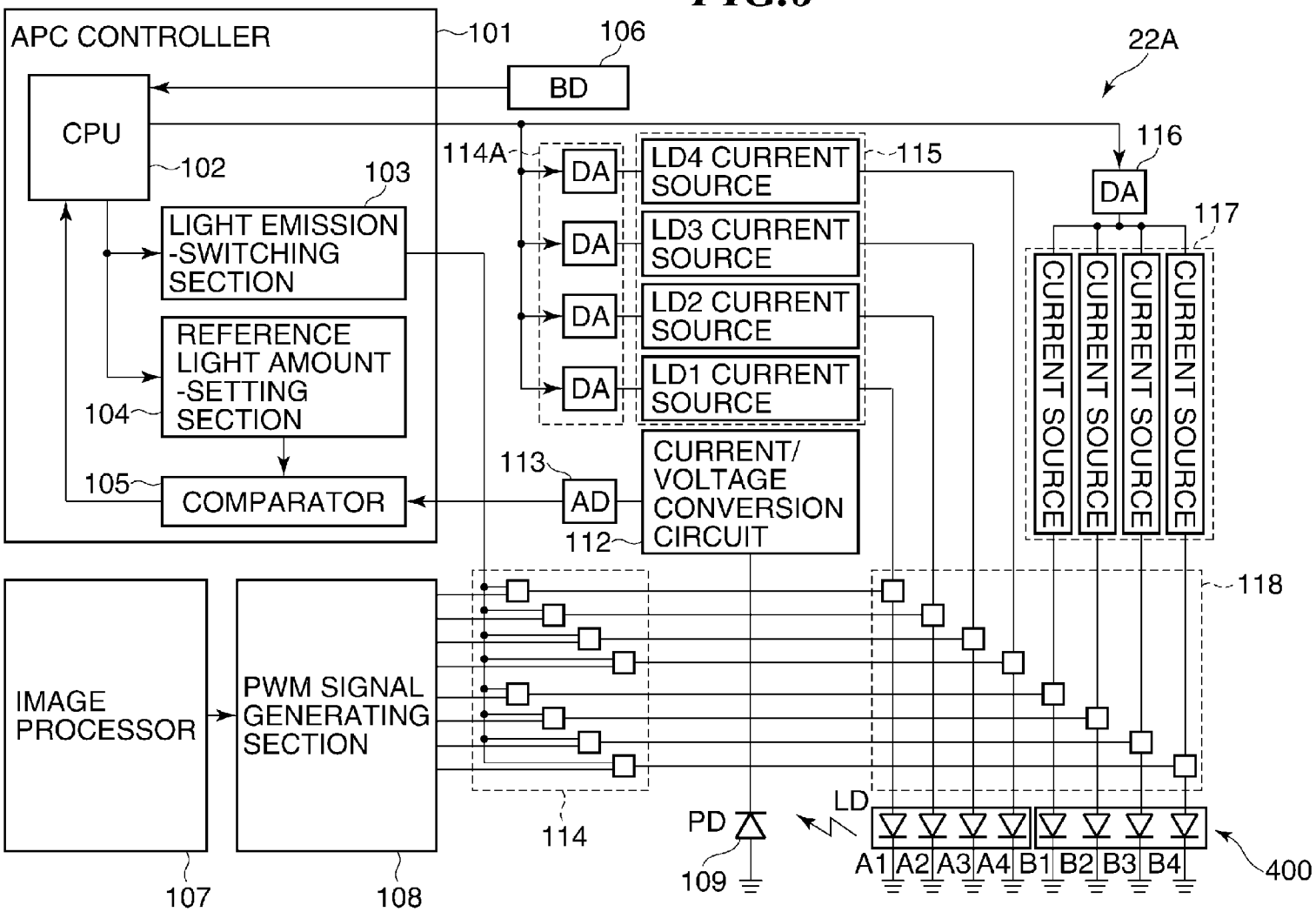
FIG. 6 is a block diagram of a laser drive circuit used in the exposure device appearing in FIG. 1.

FIG. 6 is a block diagram of a laser drive circuit 22A used in the exposure device 22 appearing in FIG. 1. Referring to FIG. 6, the laser drive circuit 22A operates in synchronism with the BD detection signal output from the BD sensor 106 (see FIG. 2) and drives the laser elements A1 to A4 and B1 to B4 (see FIG. 2) according to image data in an image area. Further, the laser drive circuit 22A performs light amount control (APC) of the laser elements A1 to A4 and B1 to B4 in a non-image area, as will be described in detail hereinafter.

Here, a description will be given, by way of example, of a case where scanning and exposure control is performed on each two laser beams to form each multi-exposed-spot, by changing an exposure time period on a laser beam-by-laser beam basis based on the same image data. Note that reference numeral 107 in FIG. 6 denotes the image processor which is referred to hereinabove with reference to FIG. 1, and the image processor 107 is incorporated in the image forming apparatus 1A. The laser drive circuit 22A comprises a PWM (pulse width modulation) signal generating section 108, a selector group 114, a current switch group 118, a laser element (LD) current source group 115, a current source group 117, a current/voltage conversion circuit 112, and an APC controller 101.

As described with reference to FIG. 1, the image processor 107 generates image data. The image data is delivered to the PWM signal generating section 108. The PWM signal generating section 108 generates a PWM signal for controlling light emission time for each pixel based on the image data. The PWM signal is selectively delivered to a current switch of the current switch group 118 via an associated selector in the selector group 114. As shown in FIG. 6, the current switch group 118 is connected to the laser elements A1 to A4 and B1 to B4.

Each current switch of the current switch group 118 operates according to a PWM signal to turn on and off a drive current for an associated one of the laser elements A1 to A4 and B1 to B4. Thus, light emission time of each of the laser elements A1 to A4 and B1 to B4 for an associated pixel position is controlled.

In the present example, each of the laser elements A1 to A4 functions as a second light source to emit a second light beam as a laser beam. On the other hand, each of the laser elements B1 to B4 functions as a first light source to emit a first light beam as a laser beam. In the image processor 107, image data for the laser elements B1 to B4 in the N-th scanning is copied as image data for the laser elements A1 to A4 in the (N+1)-th scanning. By this processing, the laser elements A1 to A4 are subjected to exposure control according to the same image data as image data used for the laser elements B1 to B4 in the immediately preceding scanning. This causes each multi-exposed-spot to be exposed according to an identical image data item for an identical pixel.

Next, an APC operation will be described. As shown in FIG. 6, the APC controller 101 comprises a CPU (central processing unit) 102, a light emission-switching section 103, a reference light amount-setting section 104, and a comparator 105. The CPU 102 gives the light emission-switching section 103 an instruction of light emission timing for an APC operation. As a consequence, the light emission-switching section 103 generates APC light emission signals for instructing the respective laser elements A1 to A4 and B1 to B4 to emit light. The APC light emission signals are delivered to the selector group 114, and the selector group 114 selectively delivers PWM signals as APC signals to the switches of the current switch group 118 according to the respective APC light emission signals. As a consequence, the switches in the current switch group 118 are subjected to on/off control by the respective PWM signals, whereby drive currents are supplied from the current sources 115 and 117 to the respective laser elements A1 to A4 and B1 to B4.

Note that timing in which the APC light emission signals are output from the light emission-switching section 103 for execution of APC will be described hereinafter. Electric currents are always output from the current sources 115 and 117. The PWM signals and the APC signals (PWM signals selected according to the APC light emission signals) are delivered from the PWM signal generating section 108 to the current switch group 118, whereby electric power is supplied from the current sources 115 and 117 to the laser elements A1 to A4 and B1 to B4. The switches of the current switch group 118 turn on and off according to the respective associated PWM signals or APC signals to thereby drive the laser elements A1 to A4 and B1 to B4, respectively.

The light amount of each of laser beams output from the respective laser elements A1 to A4 and B1 to B4 is detected by the photodiode 109, as described hereinbefore. The photodiode 109 generates an electric current corresponding to the received light amount as a detection result for execution of APC. The electric current is converted to a voltage by the current/voltage conversion circuit 112, the voltage is converted to a digital signal corresponding to the voltage value by an AD converter 113, and then the digital signal is input to the APC controller 101. The comparator 105, which has received a reference light amount from the reference light amount-setting section 104, performs a comparison between the reference light amount and the laser light amount indicated by the digital signal. Then, the comparator 105 delivers the result of the comparison to the CPU 102.

The CPU 102 outputs a drive current control signal indicative of a drive current for the associated one of the laser elements A1 to A4 and B1 to B4 according to the comparison result such that the reference light amount and the laser light amount become equal to each other, i.e. the difference between the reference light amount and the laser light amount becomes equal to zero. The drive current control signals are converted to analog signals by a DA converter group 114A and a DA converter 116. Output currents from the LD current source group 115 and the current source group 117 are determined according to the respective analog signals. In the example shown in FIG. 6, drive currents to be supplied to the laser elements A1 to A4 are set according to the respective analog signals output from DA converter group 114A (second drive current). Further, drive currents to be supplied to the laser elements B1 to B4 are commonly set according to the analog signal output from the DA converter 116 (first drive current of a predetermined value).

In the FIG. 6 example, APC is performed using e.g. the laser element A1 as a representative laser element. Then, the CPU 102 sets the drive current control signal in the DA converter 116 so as to use the drive current set for the laser element A1 by the present APC operation, as the drive current (first drive current) common to the laser elements B1 to B4. Then, multiple exposure is performed, and the CPU 102 sets the drive currents (second drive currents) for the respective laser elements A1 to A4 based on the photodiode detection signal output from the photodiode 109.

Figure 7:
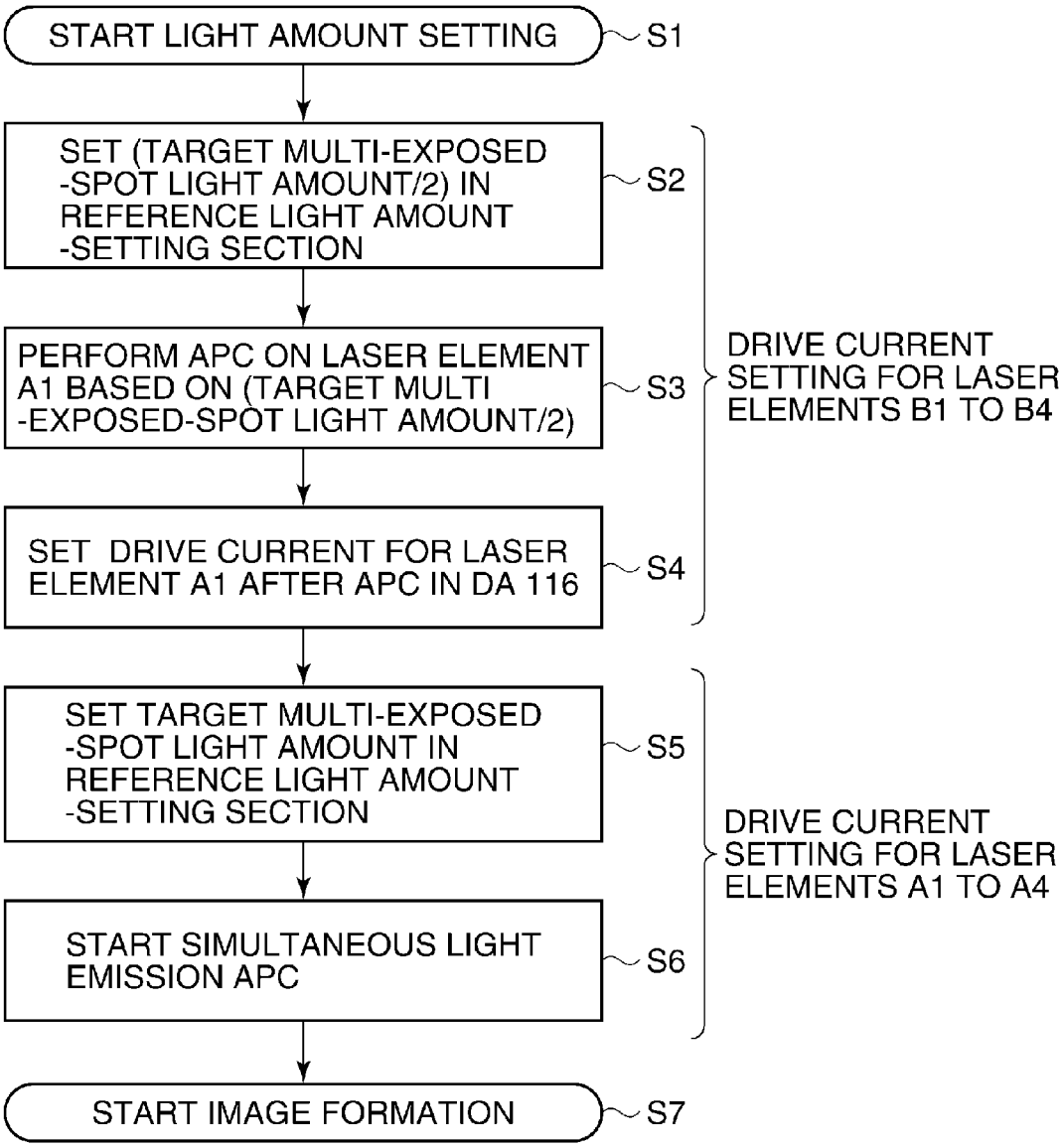
FIG. 7 is a flowchart of a light amount setting process executed by a CPU of the laser drive circuit shown in FIG. 6.

Now, the above-described operation will be described in more detail. FIG. 7 is a flowchart useful in explaining the operation of the CPU 102 of the laser drive circuit 22A shown in FIG. 6. Referring to FIGS. 6 and 7, first, the light amounts of the respective laser elements A1 to A4 and B1 to B4 are set before the start of an image forming operation. The CPU 102 starts light amount setting for the laser elements A1 to A4 and B1 to B4 (step S1). Then, the CPU 102 sets half the target multi-exposed-spot light amount (target intensity) which is a target light amount for a multi-exposed-spot, as a target value in the reference light amount-setting section 104 (step S2). Then, the CPU 102 executes APC by controlling the laser element A1 alone to emit light (step S3). By executing the steps S2 and S3, it is possible to determine a drive current required to cause the laser element A1 to perform light emission in half the target multi-exposed-spot light amount (target light amount).

Next, the CPU 102 sets the drive current control signal in the DA converter 116 so as to set the drive current determined in the step S3, as a drive current for the laser elements B1 to B4 (step S4). Thus, the drive current required to cause the laser element A1 as the representative laser element to perform light emission in half the target multi-exposed-spot light amount is set for the laser elements B1 to B4.

Further, the CPU 102 sets the target multi-exposed-spot light amount in the reference light amount-setting section 104 (step S5). Then, the CPU 102 starts APC by causing the laser elements A1 to A4 and B1 to B4 to simultaneously emit light (start of simultaneous light emission APC: step S6). In the simultaneous light emission APC, APC is performed by causing each associated pair of the laser elements A1 to A4 and B1 to B4, which form a multi-exposed-spot, to emit light simultaneously. At this time, the photodiode 109 detects the total value of the light amounts of laser beams from each two laser elements (which means that the photodiode 109 simultaneously receives laser beams from each pair of laser elements, such as the laser beams A1 and B1). The CPU 102 performs APC according to PD detection signals indicative of the respective total values (i.e. results of the light reception). Image formation starts after execution of the simultaneous light emission APC (step S7).

Figure 8:
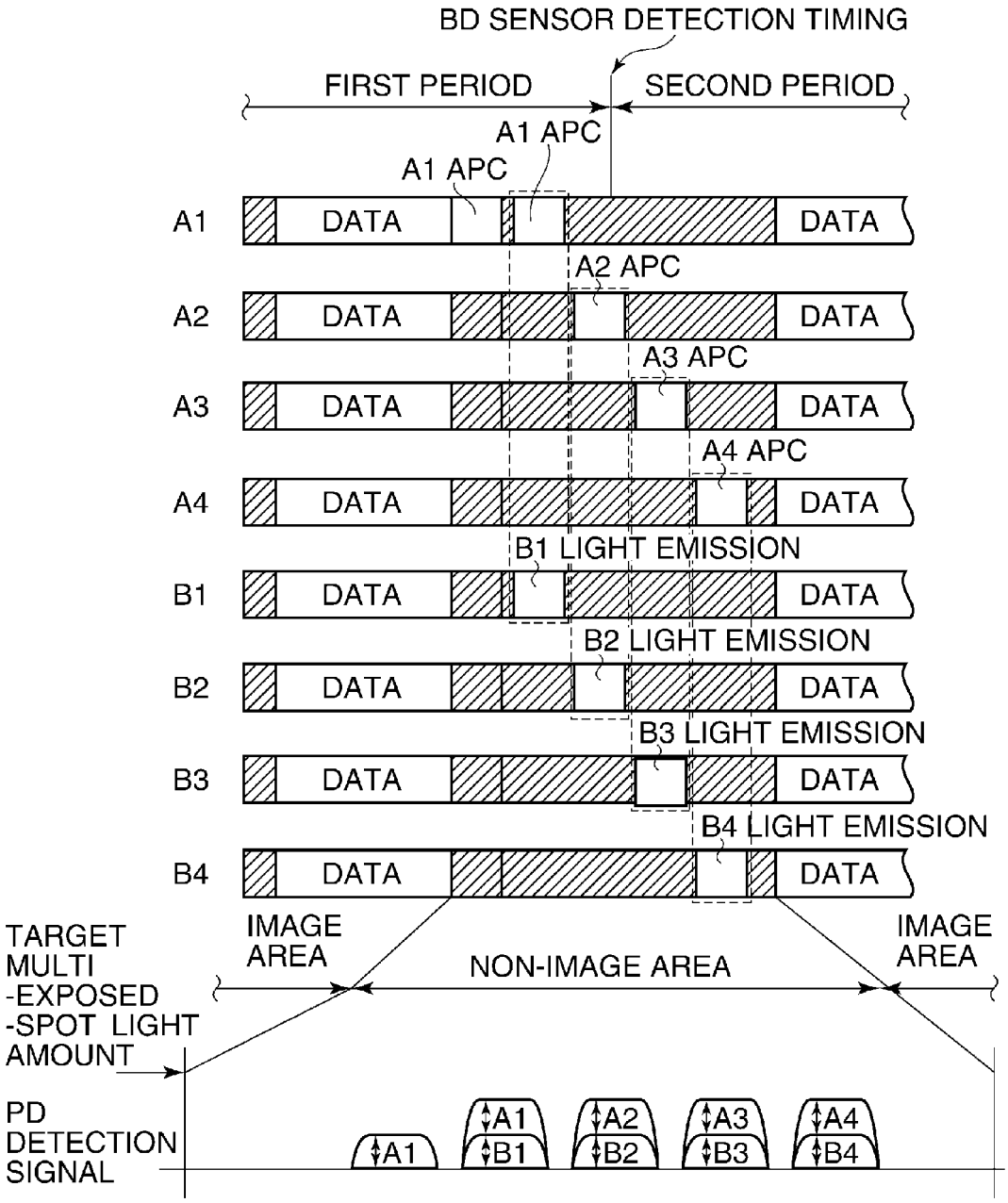
FIG. 8 is a diagram useful in explaining an APC sequence executed by the laser drive circuit shown in FIG. 6.

FIG. 8 is a diagram useful in explaining an APC sequence executed by the laser drive circuit 22A shown in FIG. 6.

Referring to FIGS. 6 and 8, in the present example, the laser drive circuit 22A performs APC by causing simultaneous light emission of the laser elements A1 and B1, the laser elements A2 and B2, the laser elements A3 and B3, and the laser elements A4 and B4, respectively. As shown in FIG. 8, in an n-th period, APC is performed for the laser element A1 by causing the same to singly emit light to thereby determine a common drive current for driving the laser elements B1 to B4. Then, APC is performed for the laser element A1 and laser element B1 emits light at the same time. Then, in detection timing of the BD sensor 106, APC is performed for the laser element A2, and the laser element B2 emits light at the same time. Similarly, in an n+1-th period, APC is performed for the laser element A3, and the laser element B3 emits light at the same time. Then, APC is performed for the laser element A4, and the laser element B4 emits light at the same time. In this case, the laser elements B1 to B4 are driven by the common drive current (selected drive current, i.e. set drive current) set in the step S4 described with reference to FIG. 7. The CPU 102 sequentially controls the drive currents (second drive current) for the laser elements A1 to A4 to thereby control each of the multi-exposed-spot light amounts to the predetermined target multi-exposed-spot light amount (target intensity).

As described above, in the above-described example, the drive current for the laser elements B1 to B4 is controlled using the laser element A1 as the representative laser element based on a light emission amount characteristic of the laser element A1 with respect to the drive current. More specifically, the CPU 102 sets the drive current calculated such that the amount of light emitted from the laser element A1 as the representative laser element becomes equal to approximately half the predetermined target multi-exposed-spot light amount, for the laser elements B1 to B4. Further, the CPU 102 controls the light amounts of the respective laser elements A1 to A4 according to the predetermined target multi-exposed-spot light amount and the detected light amounts detected by the photodiode 109. This makes it possible to accurately control the light amounts associated with the multi-exposed-spots.

The exposure device 22 described with reference to FIG. 2 performs multiple exposure for irradiating identical spots on the photosensitive drum 408 with laser beams reflected on respective adjacent polygon surfaces of the polygon mirror 405. By executing the multiple exposure, it is possible to reduce influence of scanning position shift caused e.g. by surface tilt (polygon surface tilt) of the polygon mirror 405.

Figure 9:
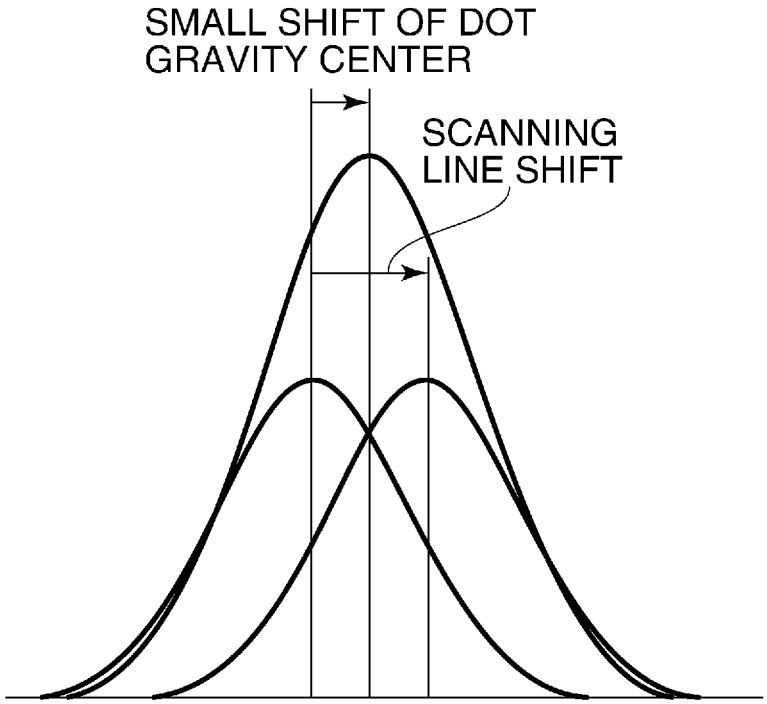
FIG. 9 is a diagram useful in explaining the positions of dots formed when scanning position shift occurs in multiple exposure performed by the exposure device appearing in FIG. 2.
Figure 10:
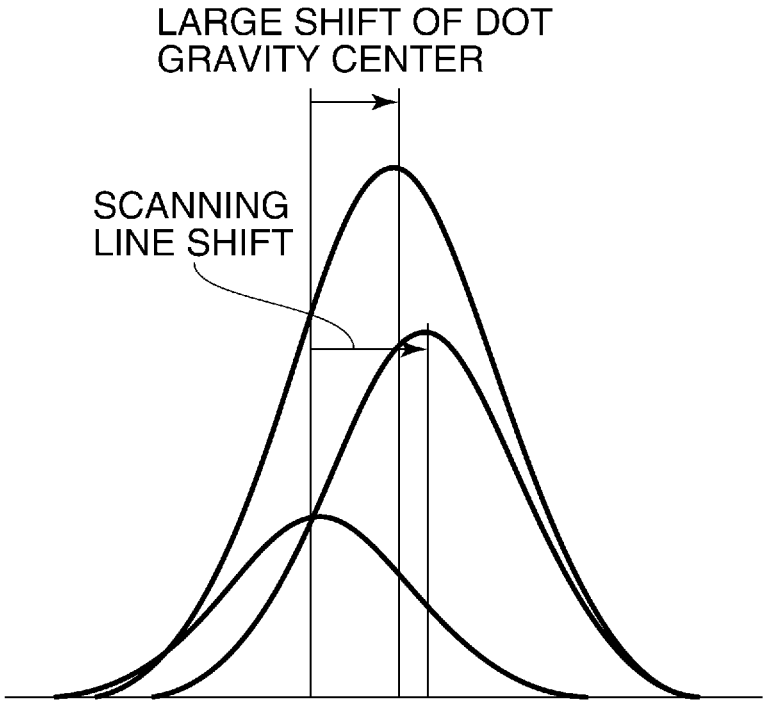
FIG. 10 is a diagram useful in explaining the positions of dots formed when the difference in light amount between a plurality of laser spots to form a multi-exposed-spot is increased in multiple exposure performed by the exposure device appearing in FIG. 2.

FIG. 9 is a diagram useful in explaining the positions of dots formed when a scanning position shift occurs in multiple exposure performed by the exposure device 22 appearing in FIG. 2. FIG. 10 is a diagram useful in explaining the position of a dot formed when the difference in light amount between laser spots for forming a multi-exposed-spot has increased in multiple exposure performed by the exposure device 22 appearing in FIG. 2.

Referring to FIG. 9, in multiple exposure in which single dots are formed using a plurality of scanning lines, when the position of one scanning line for forming a multi-exposed-spot shifts, each dot is formed at the center between the position of the single scanning line and the other scanning line for forming the multi-exposed-spot. For this reason, even if a certain scanning line has undergone an abrupt shift in scanning position e.g. due to a polygon surface tilt, the amount of movement of the center of gravity of a dot is slight. Therefore, in multiple exposure, it is possible to reduce non-uniform density that occurs due to a shift in scanning position. In order to take advantage of this merit of multiple exposure, it is desirable to make the respective light amounts of laser spots for forming a multi-exposed-spot substantially equal to each other.

On the other hand, when the difference in light amount between laser spots for forming a multi-exposed-spot has increased, a shift of the center of gravity of a dot occurs due to a difference in intensity between the laser spots, as shown in FIG. 10. As a result, the effect of reducing non-uniform density is considerably lost. To cope with this problem, in the laser drive circuit 22A in FIG. 6, the CPU 102 controls the drive current for the laser elements B1 to B4 such that the amount of light emitted from each of the laser element B1 to B4 becomes equal to approximately half the predetermined target multi-exposed-spot light amount.

The target multi-exposed-spot light amount varies with time due to a change in an ambient environment where the image processor 107 is placed and wear of the photosensitive drum 408. For this reason, the light amount of a multi-exposed-spot is not always constant. Further, a drive current for each laser element and an optical output (laser beam) from the laser element vary with e.g. a change in temperature of a chip surface. Therefore, when the laser elements B1 to B4 are each constantly driven by a fixed drive current for light emission, there sometimes occurs a considerable change in the ratio of the light amount of light emitted from each of the laser elements B1 to B4 with respect to the predetermined target multi-exposed-spot light amount. As a consequence, it becomes difficult to maintain the merit of multiple exposure.

In the laser drive circuit 22A described with reference to FIG. 6, the drive current for the laser elements B1 to B4, which are driven by the common drive current, is determined according to the drive current characteristic of the laser element A1 as the representative laser element. As a consequence, the light amount ratio between the laser elements A1 to A4 and the laser elements B1 to B4 does not largely change, so that it is possible to take an advantage of the merit of multiple exposure. Note that although in the above-described example, the laser element A1 is used as the representative laser element, this is not limitative, but the laser element A2, A3, or A4 may be used as the representative laser element in place of the laser element A1.

Alternatively, a method may be employed in which each of the laser elements B1 to B4 is lighted individually before the start of an image forming operation, drive currents are determined which make the light amounts of the respective laser elements B1 to B4 equal to half the target multi-exposed-spot light amount, and an average value of the determined drive currents is set as a common drive voltage.

In this case, since the common drive voltage is set directly based on respective light emission amount characteristics of the laser elements B1 to B4 with respect to the drive current, it is possible to improve accuracy in determining the amount of light to be emitted from each of the laser elements B1 to B4. Further, in the above-described example, since APC is performed such that a light amount associated with a multi-exposed-spot becomes equal to the target multi-exposed-spot light amount, it is possible to form a dot of uniform density using the multi-exposed-spot. Furthermore, the laser elements B1 to B4 are controlled by the common drive current (set drive current), it is not required to provide a DA converter for each of the laser elements B1 to B4, which makes it possible to perform multiple exposure without increasing circuit size. This also makes it possible to determine a targeted light amount without performing special factory adjustment for each of the laser elements before shipment.

Further, since the drive current for the laser elements B1 to B4 is determined based on the light emission amount characteristic of the laser element A1 as the representative laser element, it is possible to effectively prevent a sharp light amount change due to a temperature rise and aging of the entire chip. What is more, since the amount of light emitted from each of the laser elements B1 to B4 becomes substantially equal to the amount of light emitted from an associated one of the laser elements A1 to A4, it is possible to reduce non-uniform density caused by multiple exposure. In addition, since APC is performed by causing each two laser elements to emit light simultaneously, the number of times of execution of APC can be reduced to half the number of times of execution of APC performed on an individual basis for each of the laser elements, which makes it possible to improve accuracy in APC.

Although in the above-described embodiment, each multi-exposed-spot is subjected to multiple exposure using two laser beams, the present invention can also be applied to a case where each multi-exposed-spot is subjected to multiple exposure using three or more laser beams. In this case, APC is performed for one of laser elements, and the other laser elements are caused to emit light by a common drive current. This makes it possible to reduce the circuit size and time required for execution of APC similarly to the above.

Figure 11:
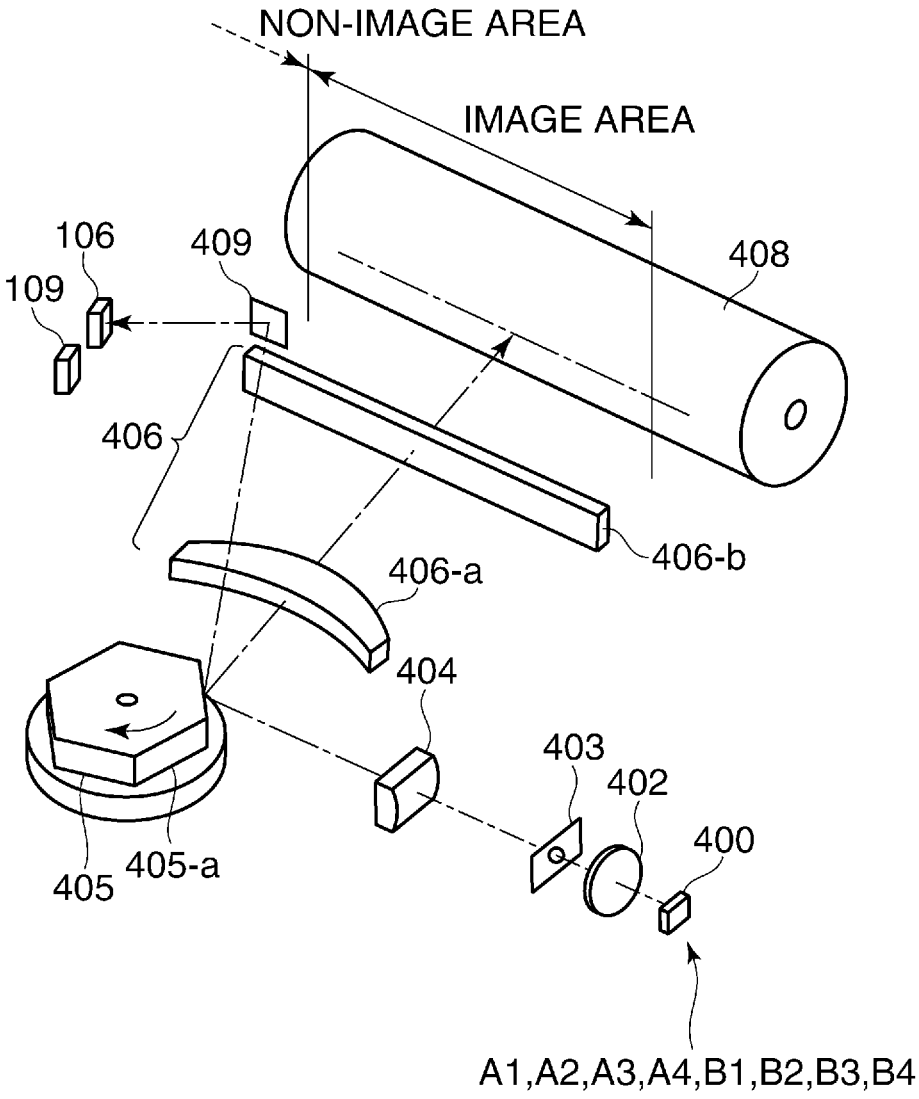
FIG. 11 is a perspective view useful in explaining an optical system of an exposure device according to a second embodiment of the present invention.

Next, a second embodiment of the present invention will be described. FIG. 11 is a perspective view useful in explaining an optical system of an exposure device 22 according to the second embodiment. An image forming apparatus including the exposure device 22 of the present embodiment is identical in construction to the image forming apparatus of the first embodiment except for the optical system, and therefore corresponding component elements are denoted by the same reference numerals while omitting description thereof.

In the optical system in the second embodiment shown in FIG. 11, the photodiode 109 is disposed adjacent to the BD sensor 106. In the present embodiment, the photodiode 109 detects a laser beam scanned by the polygon mirror 405, and delivers a photodiode detection signal indicative of the detected laser beam to the laser drive circuit 22A shown in FIG. 6. This means that the photodiode 109 is disposed on the output side of the polygon mirror 405. The laser drive circuit 22A drivingly controls the laser elements A1 to A4 and B1 to B4 as described hereinbefore. The optical system shown in FIG. 11 dispenses with optical components, such as the half mirror 410 and the condensing lens 411 appearing in FIG. 2, so that it is possible to reduce the number of component parts. Thus, APC can be performed by a simplified construction.

Figure 12:
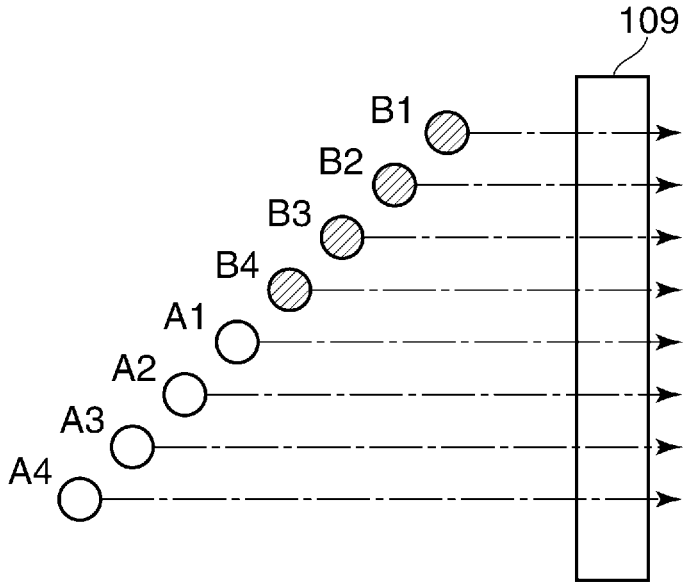
FIG. 12 is a view of scanning positions of light beams on a light receiving surface of a photodiode (PD) appearing in FIG. 11.

FIG. 12 is a view of scanning positions of light beams on a light receiving surface of the photodiode 109 appearing in FIG. 11.

In the case of irradiating a laser beam onto the photodiode 109 to thereby detect the laser beam as illustrated in FIG. 12, the light amount of the laser beam is detected in timing in which the laser beam laterally passes the photodiode 109 (i.e. a light receiver). In the example illustrated in FIG. 12, scanning spots laterally pass the light receiving surface of the photodiode 109 in the order of respective laser beams from the laser elements B1, B2, B3, B4, A1, A2, A3, and A4, whereby the amount of light emitted from each of the laser elements B1 to B4 and A1 to A4 is detected.

Figure 13:
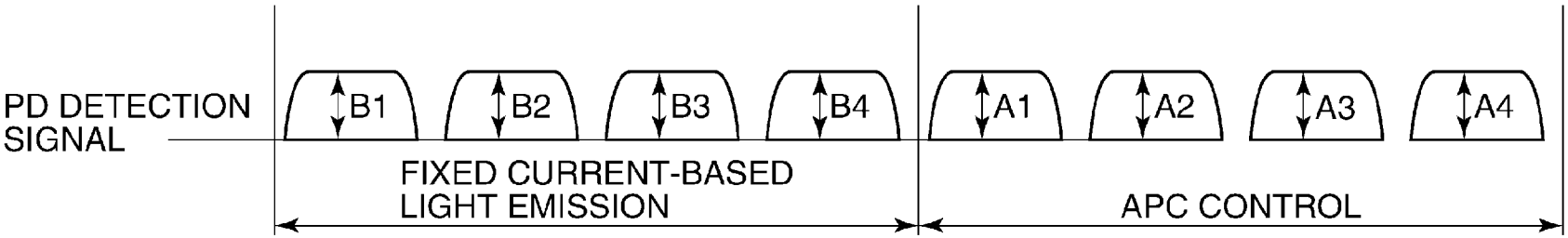
FIG. 13 is a diagram of a detection waveform of a photodiode detection signal output from the photodiode (PD) appearing in FIG. 11.

FIG. 13 is a diagram of the detection waveform of a photodiode detection signal output from the photodiode 109 appearing in FIG. 11.

Referring to FIG. 13, the light amounts of the respective laser beams are detected in the order of lateral passage on the photodiode 109. In the present example, the light amounts of the laser beams are detected in respective timings different from each other. Then, APC is executed such that the sum of light amounts of light beams forming a multi-exposed-spot becomes equal to the target multi-exposed-spot light amount, as described hereinafter. In the example illustrated in FIG. 13, the laser elements B1 to B4 are caused to emit light by a fixed current (i.e. a set drive current). On the other hand, the laser elements A1 to A4 are controlled by APC to emit light.

The laser drive circuit 22A used for the exposure device 22 appearing in FIG. 11 is identical in construction to the laser drive circuit 22A appearing in FIG. 6, but the operation of the CPU 102 is different. Therefore, the following description will be given only of the operation of the CPU 102.

Figure 14:
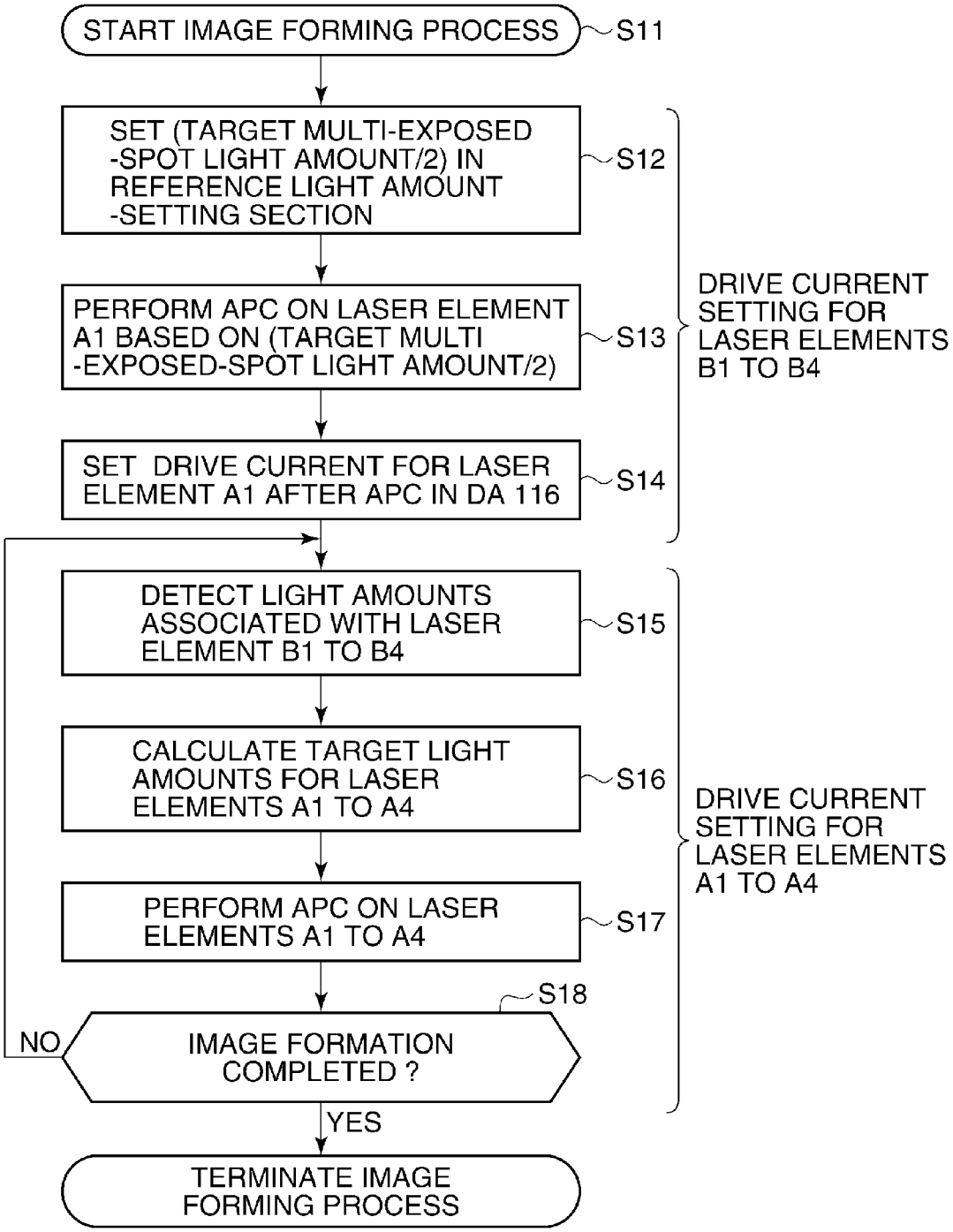
FIG. 14 is a flowchart of an image forming process executed by the CPU of the laser drive circuit.

FIG. 14 is a flowchart of an image forming process executed by the CPU 102 of the laser drive circuit 22A. Further, FIG. 15 is a diagram useful in explaining an APC sequence executed by the laser drive circuit 22A of the exposure device 22 according to the second embodiment.

Figure 15:
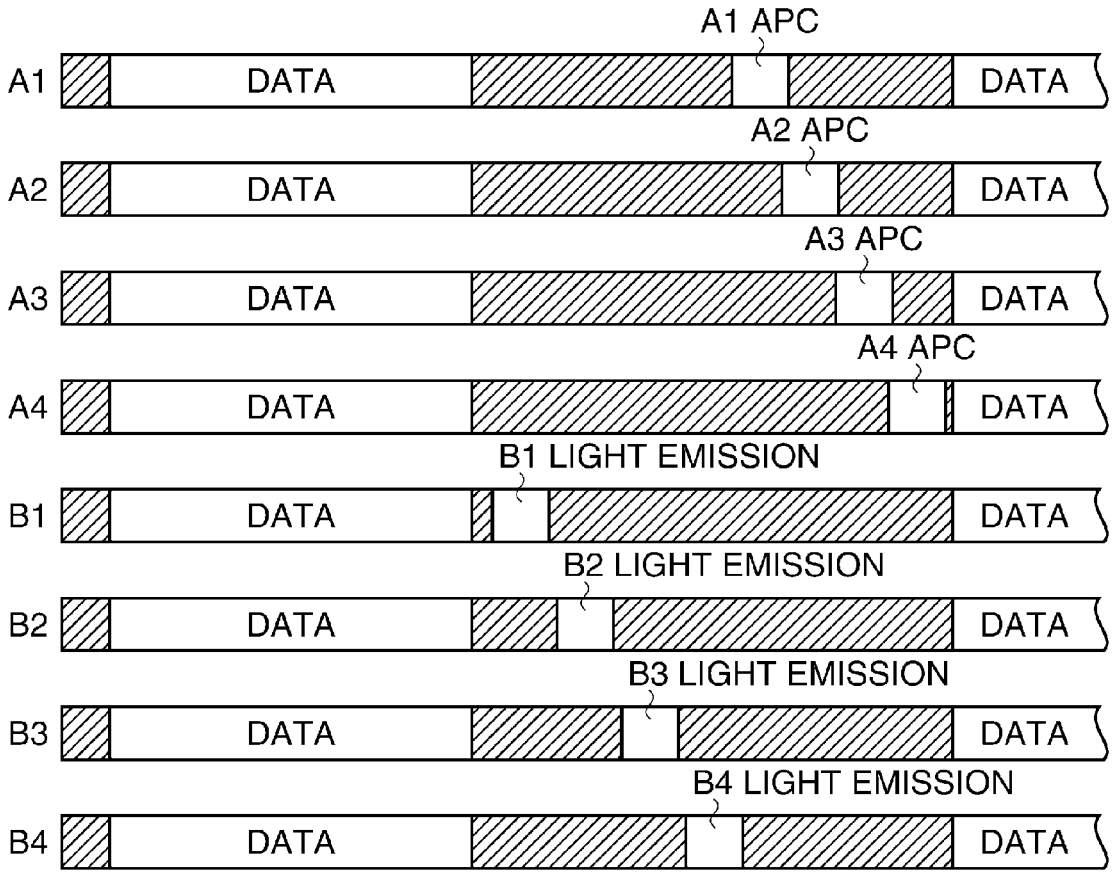
FIG. 15 is a diagram useful in explaining an APC sequence executed by the laser drive circuit of the exposure device according to the second embodiment.

Referring to FIGS. 14 and 15 in addition to FIG. 6, the CPU 102 sets a drive current common to the laser elements B1 to B4, as described hereinbefore, using the laser element A1 as a representative laser element (selected light source), as described with reference to FIGS. 6 and 7. When an image forming operation is started (step S11), the CPU 102 sets half the target multi-exposed-spot light amount as a target value in the reference light amount-setting section 104 (step S12). Then, the CPU 102 causes the laser element A1 alone to emit light according to the target value (target multi-exposed-spot light amount/2) to thereby execute APC (step S13: first light amount control). By executing the steps S12 and 13, it is possible to determine a drive current required to cause the laser element A1 to perform light emission in half the target multi-exposed-spot light amount.

Then, the CPU 102 sets the drive current control signal in the DA converter 116 so as to set the drive current determined in the step S13, as a drive current for the laser elements B1 to B4 (step S14). Thus, the drive current required to cause the laser element A1 as the representative laser element to perform light emission in half the target multi-exposed-spot light amount is set for the laser elements B1 to B4.

Then, the CPU 102 determines the light amounts of laser beams from the respective laser elements B1 to B4 detected by the photodiode 109 appearing in FIG. 11 (light amount detection: step S15). More specifically, the CPU 102 detects each of the laser beams from the respective laser elements B1 to B4 in timing of lateral passage on the photodiode 109. Then, the CPU 102 calculates the target light amounts for the respective laser elements A1 to A4 (step S16). In the step S16, the CPU 102 calculates a difference between the target multi-exposed-spot light amount and the light amount detected of each of the laser elements B1 to B4 as a differential light amount. Then, the CPU 102 sets the differential light amounts in the reference light amount-setting section 104, as target light amounts for the respective laser elements A1 to A4. More specifically, the CPU 102 calculates the target light amount for the laser element A1=target multi-exposed-spot light amount−detected light amount associated with laser element B1, the target light amount for the laser element A2=target multi-exposed-spot light amount−detected light amount associated with laser element B2, the target light amount for the laser element A3=target multi-exposed-spot light amount−detected light amount associated with laser element B3, and the target light amount for the laser element A4=target multi-exposed-spot light amount−detected light amount associated with laser element B4.

Further, the CPU 102 sequentially performs APC on the laser elements A1 to A4 in the mentioned order based on the above-described respective target light amounts in timings of detection of the light amounts associated with the respective laser elements A1 to A4 (step S17). More specifically, as shown in FIG. 15, the laser elements B1 to B4 are sequentially controlled to emit light, and thereafter APC is sequentially performed on the laser elements A1 to A4. Then, the CPU 102 determines whether or not image formation has been completed (step S18). If image formation has not been completed (NO to the step S18), the CPU 102 returns the process to the step S15 and continues the same.

On the other hand, if image formation has been completed (YES to the step S18), the CPU 102 terminates the present image forming process. As described above, the CPU 102 executes the steps S15 to S17 during image formation to thereby repeatedly carry out APC on the laser elements A1 to A4 for the respective scanning operations.

The CPU 102 performs the above-described operation, whereby the target light amount for the laser element A1 is set such that the total light amount of light amounts associated with the laser elements A1 and B1 becomes equal to the target multi-exposed-spot light amount. Then, the CPU 102 performs APC such that the amount of light emitted from the laser element A1 becomes equal to the associated target light amount. Note that similar light amount control is performed on each of the laser elements A2 to A4.

In the example described with reference to FIG. 14, in a case where light detection is performed by individually causing the laser elements to emit light in respective different timings (i.e. drive currents are supplied to the laser elements over respective different time periods), light amount control (APC) is performed such that the total light amount of respective light amounts of light beams for forming a multi-exposed-spot becomes equal to the target multi-exposed-spot light amount. Similarly to the example described with reference to FIG. 7, drive current control (adjustment) is performed on the laser element A1 as the representative laser element out of the laser elements for forming multi-exposed-spots, and the laser elements B1 to B4 are driven by the common drive current. As a consequence, it is possible to prevent an increase in circuit size. Further, since the light amounts of laser beams reflected on the polygon mirror are detected, it is possible to dispense with optical components, such as the half mirror and the condensing lens. Thus, increase in circuit size can be prevented.

As is apparent from the above, the laser drive circuit 22A functions not only as a current supply unit, but also as a control unit.

Note that the present invention is not limited to the above-described embodiments, but it can be practiced in various forms, without departing from the spirit and scope thereof.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2010-151988 filed Jul. 2, 2010, which is hereby incorporated by reference herein in its entirety.

What is claimed is:

1. An exposure device including a first light source for emitting a first light beam for exposing a photosensitive member and a second light source for emitting a second light beam for exposing the photosensitive member, and configured to irradiate the photosensitive member such that an area exposed to the first light beam and an area exposed to the second light beam at least partially overlap each other, comprising:

a current supply unit configured to supply the first light source with a first drive current having a predetermined value for causing the first light source to emit the first light beam, and supply the second light source with a second drive current for causing the second light source to emit the second light beam;

a detection unit configured to detect an intensity of the first light beam and an intensity of the second light beam, or a sum of the intensity of the first light beam and the intensity of the second light beam; and a control unit configured to control a value of the second drive current, based on a detection result from said detection unit, such that the sum of the intensity of the first light beam and the intensity of the second light beam becomes equal to a target intensity.

2. The exposure device according to claim 1, wherein said detection unit has a light receiving unit disposed at a location where the first light beam and the second light beam can be received, and detects the intensity of the first light beam and the intensity of the second light beam, or the sum of the intensity of the first light beam and the intensity of the second light beam, based on a signal from said light receiving unit.

3. The exposure device according to claim 2, wherein said control unit supplies the first drive current to the first light source and the second drive current to the second light source during respective different periods, such that the first light beam and second light beam enter said light receiving unit in respective different timings, and detects the intensity of the first light beam based on a signal output from said light receiving unit in response to reception of the first light beam and the intensity of the second light beam based on a signal output from said light receiving unit in response to reception of the second light beam.

4. The exposure device according to claim 3, wherein said control unit detects the sum of the intensity of the first light beam and the intensity of the second light beam based on the intensity of the first light beam and the intensity of the second light beam, and controls the second drive current based on a difference between the sum of the intensity of the first light beam and the intensity of the second light beam and the target intensity.

5. The exposure device according to claim 3, wherein said control unit calculates a difference between the target intensity and the intensity of the first light beam and controls the second drive current based on a difference between the calculated difference and the intensity of the second light beam.

6. The exposure device according to claim 2, wherein said control unit supplies the first drive current to the first light source and the second drive current to the second light source such that a period occurs over which the first light beam and the second light beam simultaneously enter said light receiving unit, and controls the second drive current based on a difference between the target intensity and the sum of the intensity of the first light beam and the intensity of the second light beam, which is detected based on a light reception result obtained when said light receiving unit simultaneously receives the first light beam and the second light beam.

7. An image forming apparatus including an exposure device and configured to perform image formation by causing the exposure device to scan and exposure a photosensitive member according to image data, to thereby form an electrostatic latent image corresponding to the image data on the photosensitive member, and then developing the electrostatic latent image, wherein the exposure device includes a first light source for emitting a first light beam for exposing a photosensitive member and a second light source for emitting a second light beam for exposing the photosensitive member, and configured to irradiate the photosensitive member such that an area exposed to the first light beam and an area exposed to the second light beam are at least partially overlap each other, and comprises:

a current supply unit configured to supply the first light source with a first drive current having a predetermined value for causing the first light source to emit the first light beam, and supply the second light source with a second drive current for causing the second light source to emit the second light beam;

a detection unit configured to detect an intensity of the first light beam and an intensity of the second light beam, or a sum of the intensity of the first light beam and the intensity of the second light beam; and a control unit configured to control a value of the second drive current, based on a detection result from said detection unit, such that the sum of the intensity of the first light beam and the intensity of the second light beam becomes equal to a target intensity.

* * * * *